US006606920B2

(12) United States Patent
Hawkins et al.

(10) Patent No.: US 6,606,920 B2
(45) Date of Patent: Aug. 19, 2003

(54) TUBE NON-DESTRUCTIVE TESTING PROBE DRIVE ELEVATOR AND CONTAMINATION CONTAINMENT SYSTEM

(75) Inventors: Philip J. Hawkins, Irwin, PA (US); Robert J. Maurer, Murrysville, PA (US)

(73) Assignee: Westinghouse Electric Company LLC, Pittsburgh, PA (US)

( * ) Notice: Subject to any disclaimer, the term of this patent is extended or adjusted under 35 U.S.C. 154(b) by 0 days.

(21) Appl. No.: 10/038,318

(22) Filed: Jan. 3, 2002

(65) Prior Publication Data

US 2003/0121340 A1 Jul. 3, 2003

(51) Int. Cl.[7] ..... G01D 21/00

(52) U.S. Cl. ..... 73/866.5; 324/220; 73/623

(58) Field of Search ..... 73/866.5, 623, 73/865.9; 324/200, 221; 165/11.2; 376/249

(56) References Cited

U.S. PATENT DOCUMENTS

| | | | | |
|---|---|---|---|---|
| 4,505,323 A | * | 3/1985 | De La Pintiere et al. | 165/11.2 |
| 4,757,258 A | * | 7/1988 | Kelly, Jr. et al. | 324/220 |
| 4,984,627 A | * | 1/1991 | LeBourgeois | 166/11.2 |
| 5,025,215 A | * | 6/1991 | Pirl | 324/220 |
| 5,174,165 A | | 12/1992 | Pirl | |
| 5,256,966 A | * | 10/1993 | Edwards | 324/220 |

* cited by examiner

*Primary Examiner*—Helen Kwok
*Assistant Examiner*—Nashmiya Fayyaz

(57) ABSTRACT

An improved tube inspection probe delivery system that supports a probe pusher that drives a cable connected to the probe through a flexible conduit into a tube for inspection. The probe pusher is mounted on an elevator that advances the probe pusher toward or retracts the probe pusher from the general direction of the tube as the probe is moved from tube to tube for inspection of a plurality of tubes, to maintain a substantially constant slack in the flexible conduit. The probe drive system includes a containment to control contamination that may be emitted from the tube during the inspection process.

21 Claims, 7 Drawing Sheets

TUBE NON-DESTRUCTIVE TESTING PROBE DRIVE ELEVATOR AND CONTAMINATION CONTAINMENT SYSTEM

BACKGROUND OF THE INVENTION

Pressurized water nuclear reactors employ steam generators to isolate and place a radioactive coolant, flowing in the primary circulation loop, in heat exchange relationship with a secondary fluid from which steam is generated to circulate in a secondary circulation loop. The steam generally is employed to drive a turbine to perform work, e.g., motor an electric generator. In the primary loop the reactor coolant is heated by the nuclear reactions occurring in the reactor core and circulated through a hot piping leg to a hemispherical bowl shaped portion of the primary side of the steam generator generally known as the channel head. The channel head is separated, by a partition across its diameter, into inlet and outlet plenims, which are covered by a tube sheet through which the terminating ends of U-shaped heat exchanger tubes are fastened. Each of the U-shaped heat exchanger tubes originate in a bore in the tube sheet passing from the inlet plenim of the channel head and terminate in a bore in the tube sheet that communicates with the outlet plenim of the channel head. A cylindrically shaped secondary side of the steam generator is disposed around and over the tube sheet and the U-shaped heat transfer tubes. Hot, radioactive water from the reactor core circulates through the primary side of the steam generator, while non-radioactive water is introduced into the secondary side. The tube sheet and heat exchanger tubes hydraulically isolate but thermally connect the primary side to the secondary side. Hot radioactive water from the primary side flows through the interior of these heat exchanger tubes while the exterior of these tubes come into contact with the non-radioactive water in the secondary side in order to generate non-radioactive steam.

In the secondary side of the steam generator exterior portions of the U-shaped heat exchanger tubes are supported by and extend through bores present in a plurality of horizontally supported plates that are vertically spaced along the elongated length of the tubes. Small annual spaces are present between the heat exchanger tubes and the bores in the support plates, and the tube sheet, which are known in the art as "crevice regions." Such crevice regions provide only a very limited flow path for the feed water that circulates throughout the secondary side of the steam generator, which causes "dry boiling" to occur wherein the feed water boils so rapidly that these regions can actually dry out during operation of the steam generator. This chronic drying out causes impurities in the water to precipitate and collect in these crevice regions. These precipitates ultimately create sludge and other debris that promotes the occurrence of corrosion in the crevice regions which, if not repaired, can ultimately cause the tube to crack and to allow radioactive water from the primary side to contaminate the non-radioactive water in the secondary side of the steam generator.

Eddy current probe systems are employed to monitor the extent of degradation in the walls of the heat exchanger tubes that result from corrosion. One such system is described in U.S. Pat. No. 5,174,165 issued Dec. 29, 1992 to the assignee hereof. One of the services performed at a nuclear power plant is eddy current inspection of the steam generator tubing using such a system. The inspection involves insertion and removal of various configurations of eddy current probes in the high radiation and contaminated area of a nuclear steam generator. Minimizing personal time and equipment near the manway opening through which access to the interior of the steam generator is obtained (generally referred to as the steam generator platform) is highly desirable due to the elevated radiation level in that area. Typically the probes are attached to a long flexible piece of tubing (poly) and driven with a probe pusher through a flexible conduit to an area of interest or the entire length of the steam generated tube. One end of the flexible conduit is generally fixed to the probe pusher while the opposite end is attached to and positioned under the steam generator tube with a robotic manipulator. Usually two probe pushers are used, side by side, so that two tubes can be inspected simultaneously.

Pushing the probe into the tube can be difficult due to many factors including steam generator U-bends, the length of poly, bends in the conduit, the overall length of the conduit used, moisture and restrictions in the steam generator tube. For these reasons, the probe pushers are usually located on the steam generator platform or mounted directly on the steam generator to minimize the length of flexible conduit through which the probe has to be pushed. Therefore, the probe operators are exposed to a high radiation area and the probe pusher equipment cannot be set up until the steam generator manways are removed or they would be in the way of that operation.

A second problem during eddy current inspection is that the amount of conduit in the steam generator needs to be increased or decreased as the robotic manipulator moves to various tube locations. This task is typically accomplished by manually adding or removing sections of the flexible conduit on the steam generator platform, which is a source of radiation exposure time for the field service operators.

A third area of concern is the containment of radioactive particles that are carried from the steam generator tubing by the eddy current probe and poly. Typically, eddy current testing is a major contributor of radioactive contamination on the steam generator platform, which increases down time for decontamination, monitoring, and field service personnel change out due to personnel contamination. Localized vacuum systems located near the probe pusher wheels or poly are utilized to capture radioactive particles but there is still spread of radioactive particles due to the ineffectiveness of the vacuum systems and the physical handling of probes and polys during replacement.

A final problem is that, quite frequently, the probe must be passed through calibration standards during an eddy current inspection program. If the standards are fastened to the manway, the robot must flip the conduit upside down making it difficult to remotely pass the probe through the standard. If the standards are placed in line with the conduit they make the probe pushing difficult due to management of the long standard in the steam generator.

To further improve the inspection process it would be desirable to locate the probe pushers remote from the steam generator without compromising the push capability. This would reduce personnel exposure by enabling field service personnel to operate and service the pushers and probes in a lower radiation exposure area. It would also remove the current equipment from the steam generator platform and provide additional space for other activities in a normally congested work area. Furthermore, it would enable the equipment to be set up and functionally tested prior to removal of the steam generator manways providing a direct time savings for the field crew and in some situations plant critical path.

It is an object of this invention to overcome these difficulties.

SUMMARY OF THE INVENTION

These and other objects are achieved by a system and method which enables the eddy current probe drive system to be located below the steam generator platform without impeding the push capability of the probe pushers. This is accomplished by mounting the probe pushers on an elevator that can raise and lower the conduit toward or from the tube sheet to maintain the slack in the conduit substantially the same for all positions of the robotic arm under the tube sheet. This minimizes the number of bends in the conduit which can cause an obstruction to the movement of the probe and maximizes a straight section between the manway and the probe pusher in which the calibration standard can be incorporated.

In the preferred embodiment a tent is slipped over the probe pusher having an open end through which the conduit passes and a vacuum port at a spaced distance from the open end, with the end of the tent opposite the open end closed. A vacuum drawn through the port draws air into the tent and funnels substantially all the contamination out the vacuum port from which it can be collected. Preferably, the tent is provided with a number of access doors through which the probe pusher, conduit and probe can be accessed for maintenance.

Preferably, retractable legs are provided that can stabally support the system during operation and retract for transport and storage to reduce the overall size of the system. Desirably, the legs are provided with height adjustments that can change the angular orientation of the probe pushers relative to the tube sheet.

BRIEF DESCRIPTION OF THE DRAWINGS

A further understanding of the invention can be gained from the following description of the preferred embodiments when read in conjunction with the accompanying drawings in which.

DESCRIPTION OF THE PREFERRED EMBODIMENT

Figure 1:
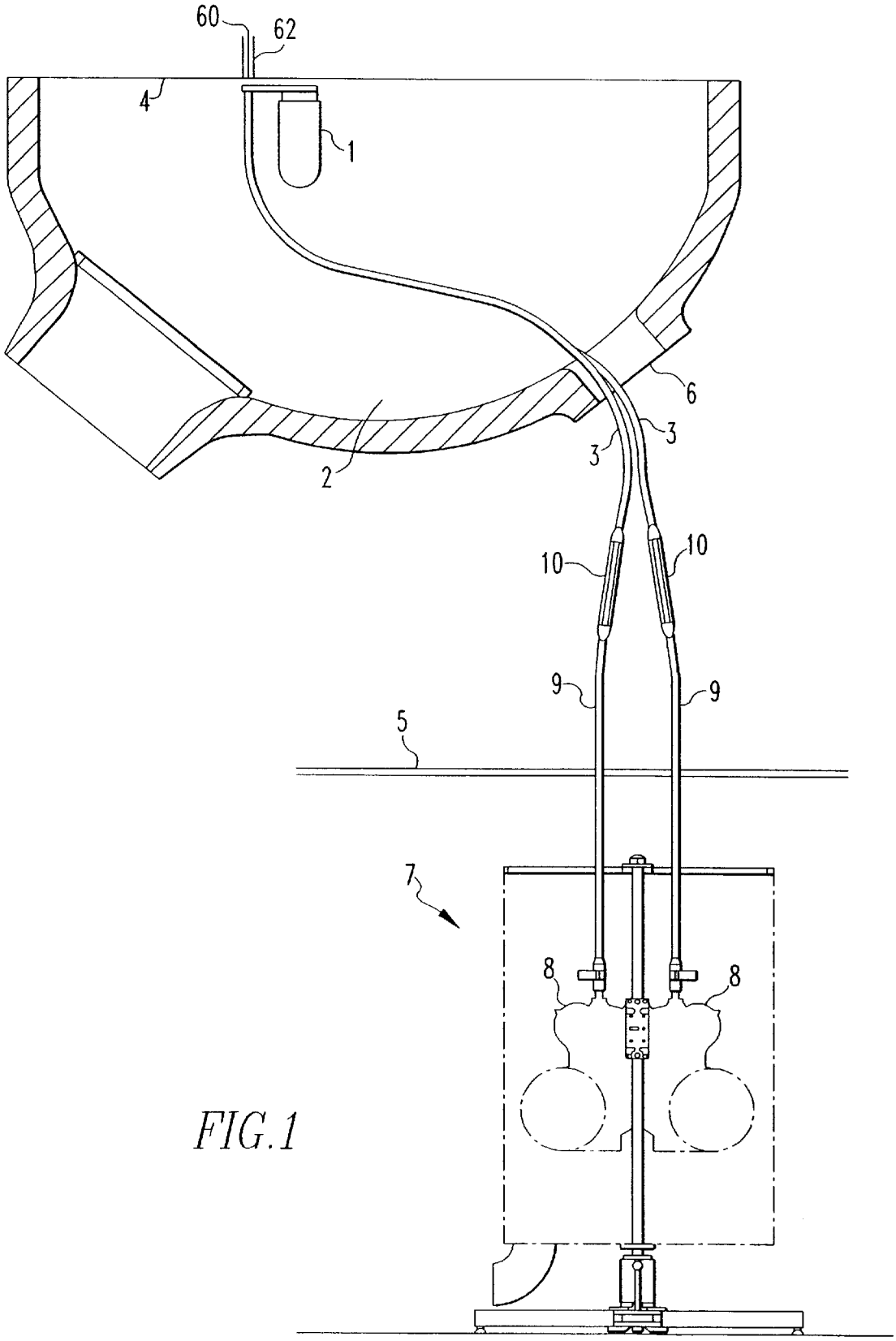
FIG. 1 is a cross-sectional view of the inlet side of the steam generator channel head with the manipulator and eddy current probe drive system of this invention figuratively illustrated below the steam generator platform.

FIG. 1 shows schematically the apparatus of this invention servicing a nuclear steam generator. Robotic manipulator (1) located inside of a channel head (2) is used to position a flexible conduit (3) near to the steam generator tube sheet (4) at a tube location to be inspected. Below the steam generator platform (5) and approximately directly beneath the manway (6) is located an elevator assembly (7), which can vertically translate the probe pushers (8). One or both of the probe pushers (8) drive an eddy current probe (60), attached to a poly, through solid tubing (9), a probe calibration standard (10), a flexible conduit (3), and then into the steam generator tube (62) of interest. Two small openings in the steam generator platform (5) permit the solid tubes (9) to translate freely. As various tubes are examined with the probes and the robotic manipulator translates parallel to the tube sheet, it can be seen that a change in the amount of flexible conduit (3) in the channel head (2) is required. In accordance with this invention, the amount of conduit in the channel head is increased or decreased by raising or lowering the probe pushers. The robot operator or a nearby worker can change the pusher height.

Figure 2:
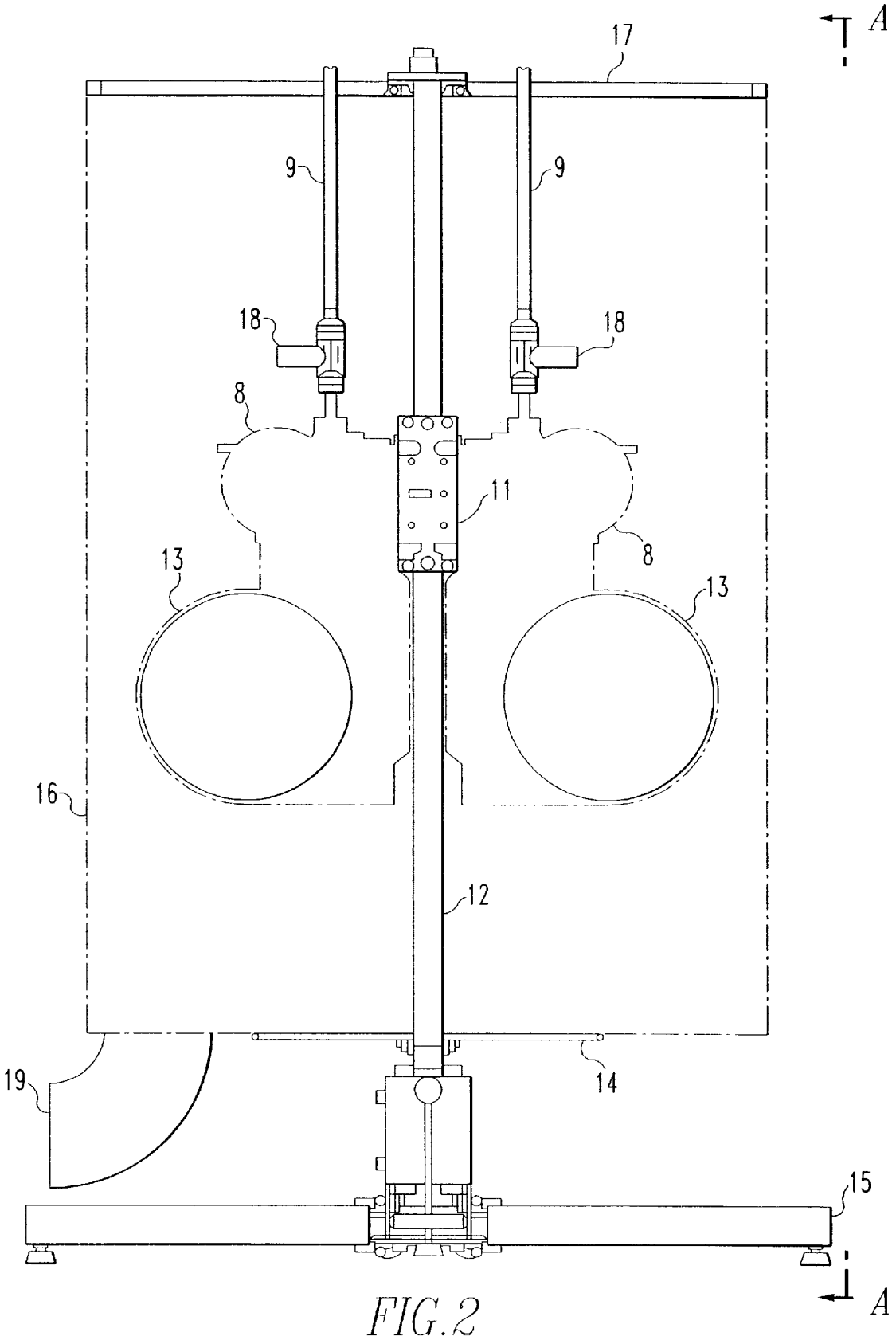
FIG. 2 is a schematic illustration of the drive portion of the steam generator eddy current probe drive system of this invention.

FIG. 2 is an enlarged view of the elevator assembly (7) shown in FIG. 1. The probe pushers (8), which are more fully described in U.S. Pat. No. 5,174,165, employ opposing, motor driven rollers which are resiliently mounted to engage and drive the probe cable or poly through the solid tubing (9) and flexible conduit (3) in order to move the probe into and out of the primary side of a steam generator. A take-up reel is also provided to store the retracted cable. The probe pushers (8) are slideably attached to carriage (11) which can vertically translate along mast (12). Each probe pusher (8) has a detachable take-up drive (13) used to store the excess poly attached to the eddy current probe. To ease the installation of the take-up drives, which weigh approximately 60 pounds each, or changeout of a pusher (8), table (14) is provided. With the pusher (8) attached to the carriage (11) and the take-up drive resting separately on the table, the pusher can be lowered directly onto the take-up drive and coupled as one assembly. The table also functions as the bottom vertical travel limit. The mast (12) is free standing and supported by up to 4 outriggers (15). The outriggers are hinged for storage against the mast or can be removed completely. Also shown in FIG. 2 is the outline of a containment tent (16) and a detachable tent support frame (17). Vacuum manifolds (18) are used for removal of loose radioactive particles as the poly passes within the solid tubing (9). Port (19) is connected to a larger volume lower pressure vacuum to draw airflow downward through the tent (17) which is open at the top. Details of the tent are discussed hereafter.

Figure 3:
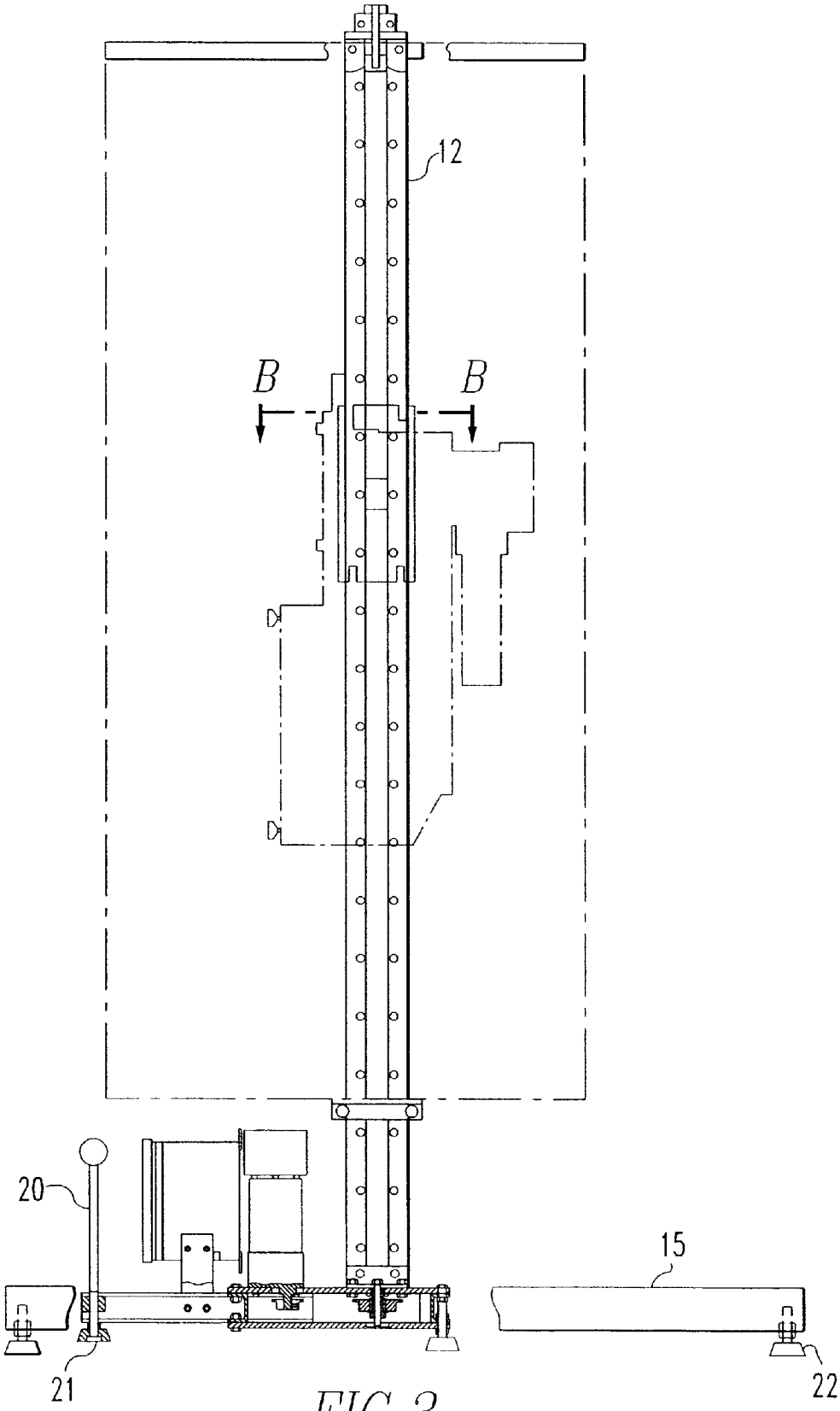
FIG. 3 is a side view of the elevator assembly shown in FIG. 2.

FIG. 3 is a side view of the elevator assembly taken along the lines A—A of FIG. 2. A jack (20) provides the option to tilt the mast (12) to accommodate space restrictions below the steam generator platform (5) shown in FIG. 1. If tilted, the mast is supported by a jack pad (21) and the two opposing adjustable outrigger pads (22).

Figure 4:
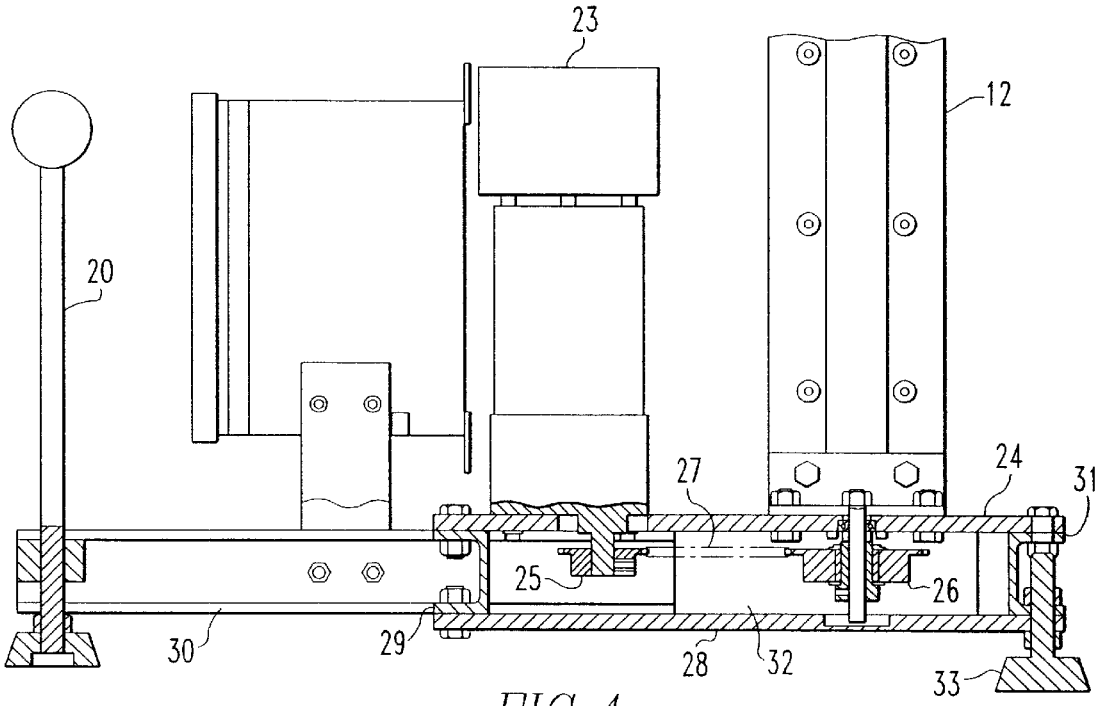
FIG. 4 illustrates an enlarged view of the bottom and of the carriage drive of the elevator assembly shown in FIG. 3 with the support table of this invention shown in section to show the drive train.

FIG. 4 shows an enlarged view of the bottom end of the carriage drive. The weight of the probe pushers and take-up drives is approximately 230 pounds. The mast (12) and a reversible gear motor/brake (23) are attached to a top transmission plate (24). A drive sprocket (25) is coupled to a driven sprocket (26) with a chain (27). To provide a rigid light weight structure to couple the mast (12) with the jack (20) and the outriggers (15) (shown in FIGS. 2 and 3), the top transmission plate (24) and the bottom plate (28) are secured together with opposing channels (29, 30, 31 and 32). Additional vertical stiffness can be obtained with adjustable pad (33).

Figure 5:
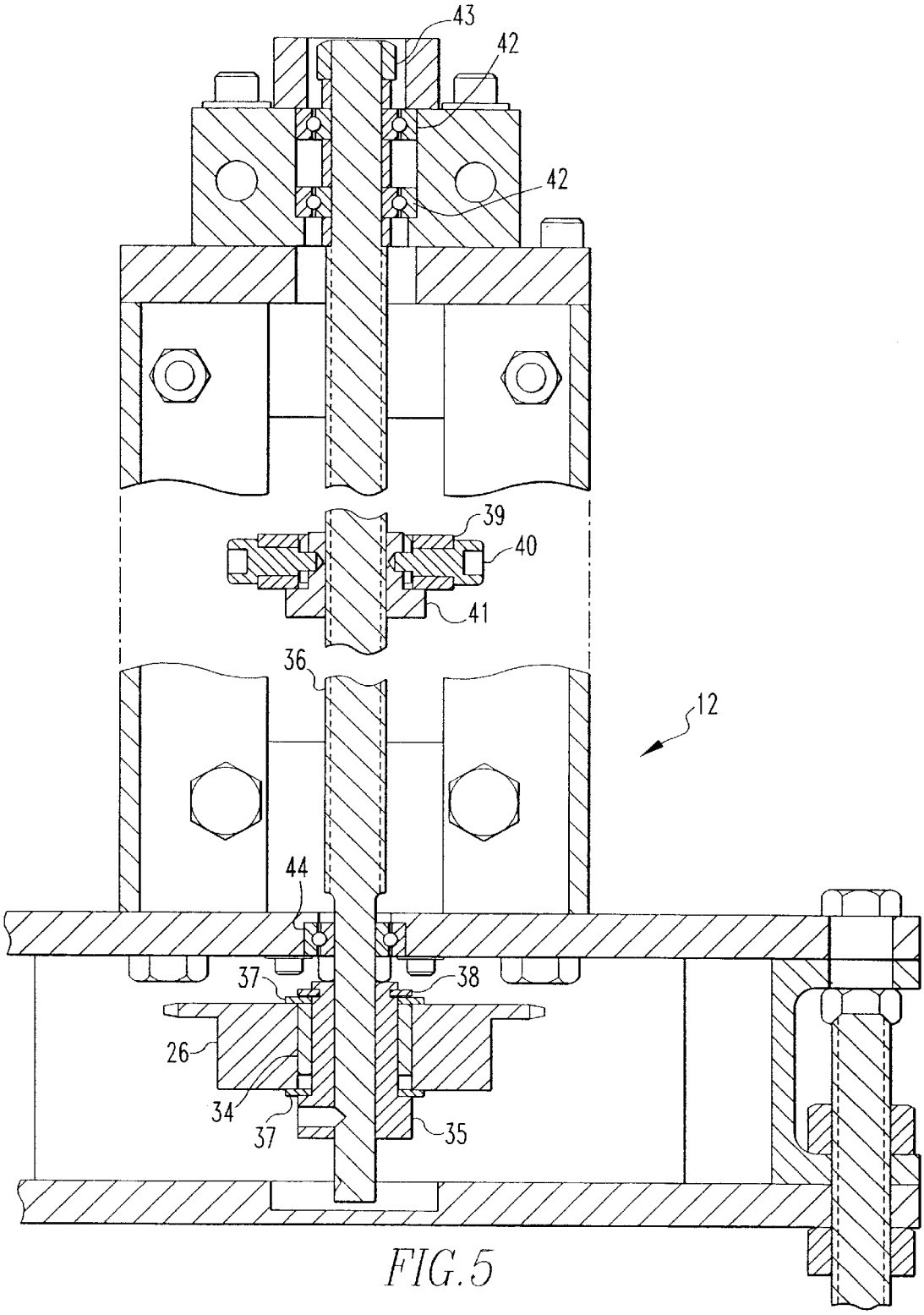
FIG. 5 is an enlarged cross-sectional view of the carriage vertical drive illustrated in FIG. 4.

FIG. 5 shows an enlarged section of the carriage vertical drive. Tightly fitted to the driven sprocket (26) is a roller clutch (34) which only transmits rotational torque in one direction to a hardened bushing (35) which is coupled to a lead screw (36). The thrust bushings (37) provide bearing surfaces between the drive sprocket (26), a bushing (35) and a retaining ring (38). The roller clutch (34) is installed to permit the motor to drive the carriage upward only. Driving the carriage downward could potentially cause the elevator assembly to tip if there was not sufficient slack in the flexible cable conduit. Additionally, use of the roller clutch eliminates the need for a down limit switch as the lead screw rotation ceases as the table (14) is contacted.

To permit the carriage to be lowered with the gear motor, the lead screw must have a sufficiently high helix angle to permit back drive with the weight of the probe pusher assemblies. This is accomplished with a pitch of 2 threads per inch. The high helix angle is also required to eliminate oscillation by reducing the lead screw rotational speed. The load from the carriage is carried by a yoke (39), transferred to the shoulder screws (40), an acme nut (41), and then to the lead screw (36). The lead screw (36) is axially supported by a set of angular contact bearings (42) and secured with a nut (43). The lead screw is loosely fitted to the inner race of the radial bearing (44) which provides only radial support to the driven sprocket (26). Since the entire thrust load from the lead screw is transmitted to the angular contact bearings (42), the lead screw loading is in tension eliminating any buckling load and therefore permitting use of a small diameter light weight lead screw.

Figure 6:
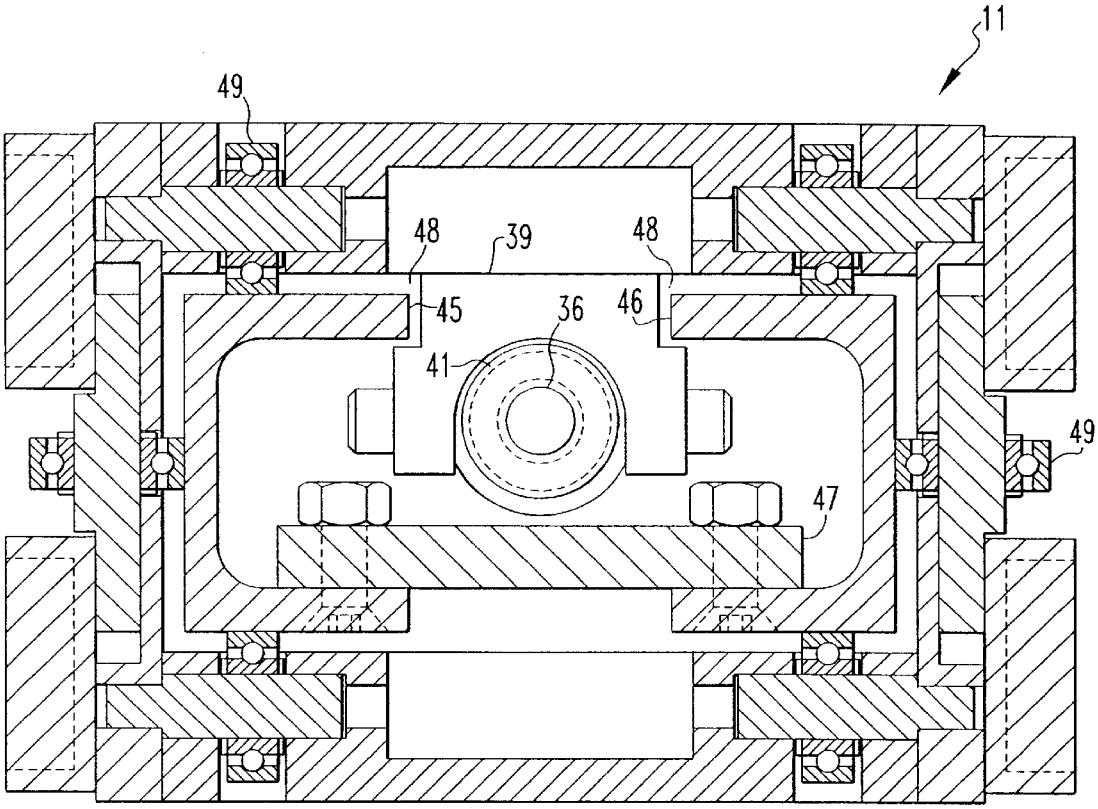
FIG. 6 is a sectional view of the mast and carriage taken along the lines B—B of FIG. 3.

FIG. 6 is a sectional view of the mast and carriage taken along the lines B—B of FIG. 3. In order to further reduce the weight and size of the structure, the mast is a composite structural shape. Channels (45 and 46) are bolted and pinned to the plate (47) forming a rigid carriage member with a narrow profile. An opening (48) provides a means to attach yoke (39) to carriage (11). Two sets of 6 ball bearings (49) on each end of the carriage provide a slidable coupling between the carriage and mast. The lead screw (36) is protected within the channels (45 and 46).

Figure 7:
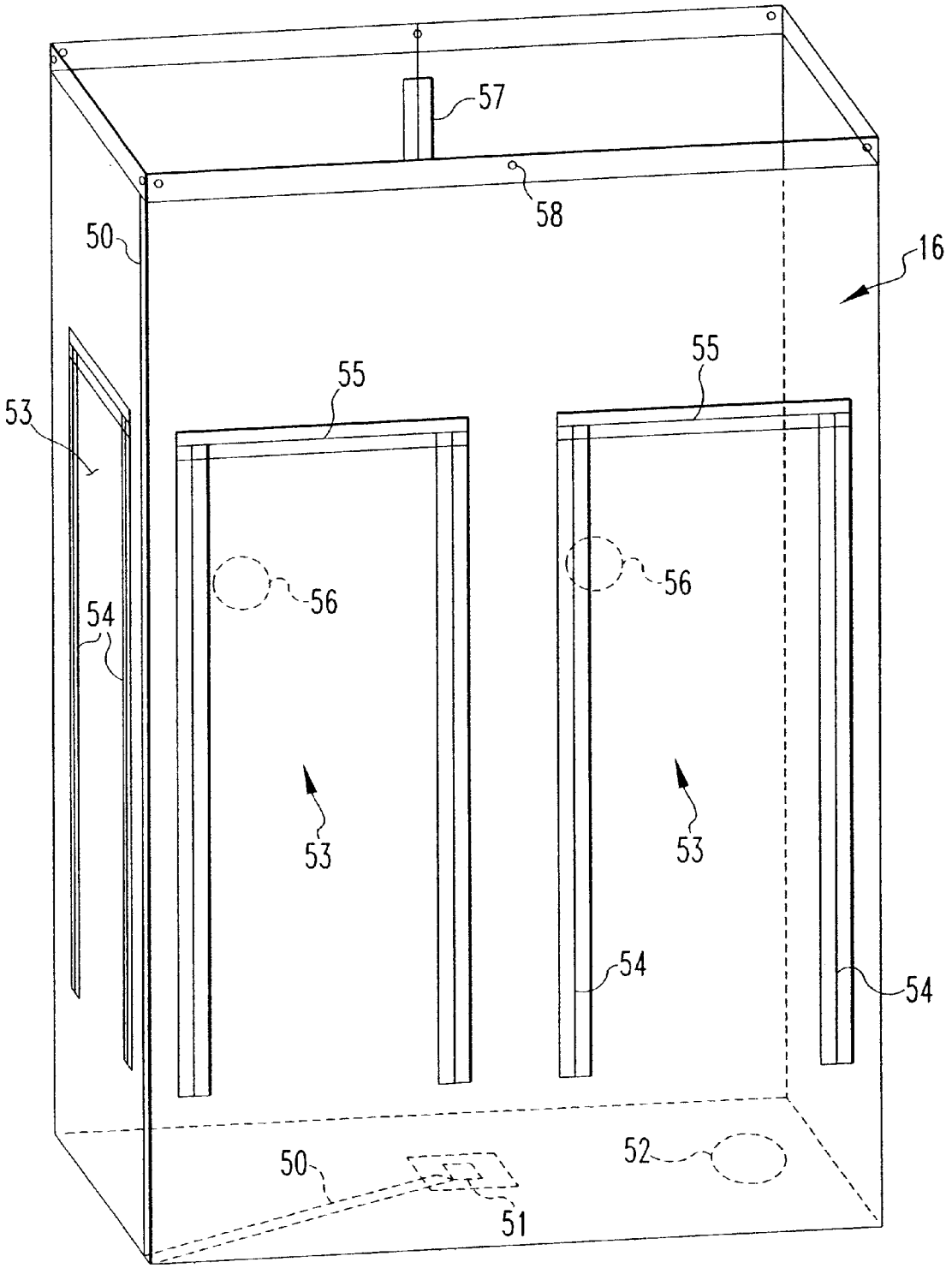
FIG. 7 is a perspective view of the containment tent of this invention.

FIG. 7 is a perspective illustration of the containment tent (16) of this invention. A velcro seam (50) permits an opening to install the tent around the mast frame (17) previously described with respect to FIG. 2, and is closely fitted to the opening (51). A high volume vacuum (approximately 250–500 cu ft/min) is connected to duct (52) and is used to draw air down through the open top of the tent (16) to remove airborne radioactive particles. Four access coverings (53) with vertical zippers (54) and top Velcro strips (55) are provided and can be opened as required for poly changes or other maintenance. Two-sleeved holes (56) in the tent rear are for cable penetration into the tent. The rear zipper (57) is for initial equipment setup. Grommets (58) are used for attaching the tent to this spar or frame (17).

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

What is claimed is:

1. Apparatus for remotely inspecting a plurality of tubes within a relative proximity of each other, the tubes disposed above a platform, comprising:

a probe for sensing a condition of the tubes integrity within the vicinity of the probe;

a probe pusher disposed under the platform for pushing the probe through one of the plurality of tubes;

a conduit connected at one end to the probe pusher and another end of the conduit adapted to communicate with the one tube;

a flexible cable extending from the probe pusher, through the conduit and connected to the probe; and means for vertically translating the probe pusher and thereby to advance and withdraw the probe pusher respectively in and from the general direction of the tubes.

2. Apparatus for remotely inspecting a plurality of tubes within a relative proximity of each other, comprising:

a probe for sensing a condition of the tubes integrity within the vicinity of the probe;

a probe pusher for pushing the probe through one of the plurality of tubes;

a conduit connected at one end to the probe pusher and another end of the conduit adapted to communicate with the one tube;

a flexible cable extending from the probe pusher, through the conduit and connected to the probe;

means for advancing and withdrawing the probe pusher respectively in and from the general direction of the tubes; and a tent over the probe pusher, having an opening at one end through which the conduit extends and hating a vacuum connection spaced from the one end of the tent for drawing air through the tent and out the vacuum connection.

3. The apparatus of claim 2 including access doors in said tent for accessing the probe pusher from the exterior of the tent.

4. The apparatus of claim 1 wherein said means for advancing and withdrawing the probe pusher comprises an elevator on which the probe pusher is supported.

5. The apparatus of claim 4 wherein the elevator comprises a carriage that rides forward and backward on a mast that supports the probe pusher.

6. Apparatus for remotely inspecting a plurality of tubes within a relative proximity of each other, comprising:

a probe for sensing a condition of the tubes integrity within the vicinity of the probe;

a probe pusher for pushing the probe through one of the plurality of tubes;

a conduit connected at one end to the probe pusher and another end of the conduit adapted to communicate with the one tube;

a flexible cable extending from the probe pusher, through the conduit and connected to the probe;

means for advancing and withdrawing the probe pusher respectively in and from the general direction of the tubes, the means comprising an elevator on which the probe pusher is supported, the elevator comprising a carriage that rides forward and backward on a mast that supports the probe pusher; and a tent over the probe pusher, having an opening at one end through which the conduit extends, the one end of the tent supported on a spar that is in turn supported by the mast.

7. The apparatus of claim 5 wherein the mast is a drive screw that drives the carriage forward.

8. Apparatus for remotely inspecting a plurality of tubes within a relative proximity of each other, comprising:

a probe for sensing a condition of the tubes integrity within the vicinity of the probe;

a probe pusher for pushing the probe through one of the plurality of tubes;

a conduit connected at one end to the probe pusher and another end of the conduit adapted to communicate with the one tube;

a flexible cable extending from the probe pusher, through the conduit and connected to the probe;

means for advancing and withdrawing the probe pusher respectively in and from the general direction of the tubes, the means comprising an elevator on which the probe pusher is supported, the elevator comprising a carriage that rides forward and backward on a drive screw that drives the carriage forward that supports the probe pusher; and a drive for driving the drive screw and, through the drive screw, the carriage in a forward direction, the drive including a slip clutch for enabling the carriage to move backward under the force of gravity.

9. The apparatus of claim 8 wherein the thread on the drive screw has a sufficient helical angle to permit the carriage to move backward under the force of gravity when the slip clutch is activated.

10. The apparatus of claim 5 including a table supported substantially proximate and substantially horizontal to the mast at a most retracted point of travel of the probe pusher.

11. The apparatus of claim 10 wherein the table forms the down limit stop of probe pusher travel.

12. The apparatus of claim 4 wherein the elevator includes a drive that only moves the elevator in the advancing direction.

13. The apparatus of claim 1 including means for changing the angular orientation of the probe pusher relative to the tubes.

14. Apparatus for remotely inspecting a plurality of tubes within a relative proximity of each other, comprising:

a probe for sensing a condition of the tubes integrity within the vicinity of the probe;

a probe pusher for pushing the probe through one of the plurality of tubes;

a conduit connected at one end to the probe pusher and another end of the conduit adapted to communicate with the one tube;

a flexible cable extending from the probe pusher, through the conduit and connected to the probe;

means for advancing and withdrawing the probe pusher respectively in and from the general direction of the tubes, the means comprising an elevator on which the probe pusher is supported, the elevator comprising a carriage that rides forward and backward on a drive screw that drives the carriage forward and supports the probe pusher; and legs for supporting the apparatus in a stable position while in operation, the legs being retractable to reduce the contour of the apparatus during transport and storage.

15. The apparatus of claim 1 including a probe calibration standard incorporated into a straight section of the conduit.

16. The apparatus of claim 15 wherein the calibration standard is incorporated into the straight section of the conduit at a sufficient distance from the probe pusher so the probe can be retracted from the calibration standard without entering the probe pusher.

17. A method of inspecting a plurality of tubes within a relative proximity of each other and disposed above a platform comprising the steps of:

providing a probe pusher below the platform remote from the tubes, with a conduit extending from the probe pusher to the vicinity of the tubes in communication with the interior of at least one of the tubes;

providing a probe connected to the probe pusher by a flexible cable extending through the conduit and into the at least one tube that the conduit is in communication with;

vertically translating the probe pusher to advance and/or retract the probe pusher to respectively insert or withdraw the probe through the at least one tube;

retracting the probe into the conduit;

moving the conduit to place the conduit in communication with the interior of a second of said plurality of tubes; and moving the probe pusher forward towards or backwards from the general direction of the tubes when the conduit is moved from the at least one of the tubes to maintain the slack in the conduit substantially the same for each tube.

18. The method of claim 17 wherein the tubes are the heat exchange tubes of the primary side of a nuclear steam generator that is supported above a steam generator platform within the vicinity of a manway of a channelhead of the steam generator, including the step of maintaining the probe pusher below the steam generator platform with the conduit extending past the platform and into the manway.

19. A method of inspecting a plurality of tubes within a relative proximity of each other comprising the steps of:

providing a probe pusher remote from the tubes, with a conduit extending from the probe pusher to the vicinity of the tubes in communication with the interior of at least one of the tubes;

providing a probe connected to the probe pusher by a flexible cable extending through the conduit and into the at least one tube that the conduit is in communication with;

providing a tent over the probe pusher, the tent having a vacuum connection;

advancing and/or retracting the probe pusher in the tent to respectively insert or withdraw the probe through the tube;

retracting the probe into the conduit;

moving the conduit to place the conduit in communication with the interior of a second of said plurality of tubes; and moving the probe pusher forward towards or backwards from the general direction of the tubes when the conduit is moved from the at least one of the tubes to maintain the slack in the conduit substantially the same for each tube; and drawing air through the tent and out the vacuum connection while the flexible cable passes within the conduit.

20. A method of inspecting a plurality of tubes within a relative proximity of each other comprising the steps of:

providing an elevator having a carriage that rides forward and backward on a mast the mast being a drive screw that drives the carriage forward, with a drive for driving the drive screw, and through the drive screw, the carriage in a forward direction, and the drive including a slip clutch for enabling the carriage to move backward under the force of gravity;

providing a probe pusher supported on the mast remote from the tubes, with a conduit extending from the probe pusher to the vicinity of the tubes in communication with the interior of at least one of the tubes;

providing a probe connected to the probe pusher by a flexible cable extending through the conduit and into the at least one tube that the conduit is in communication with;

advancing and/or retracting the elevator carriage supporting the probe pusher to respectively insert or withdraw the probe through the at least one tube;

retracting the probe into the conduit;

moving the conduit to place the conduit in communication with the interior of a second of said plurality of tubes; and moving the carriage supporting the probe pusher forward towards the general direction of the tubes when the conduit is moved from the at least one of the tubes to maintain the slack in the conduit substantially the same for each tube.

21. A method of inspecting a plurality of tubes within a relative proximity of each other comprising the steps of:

providing an elevator with legs for supporting the elevator in a stable position while in operation and retracting to reduce the contour of the elevator during transport and storage;

providing a probe pusher supported on the elevator remote from the tubes, with a conduit extending from the probe pusher to the vicinity of the tubes in communication with the interior of at least one of the tubes;

providing a probe connected to the probe pusher by a flexible cable extending through the conduit and into the at least one tube that the conduit is in communication with;

advancing and/or retracting the probe pusher to respectively insert or withdraw the probe through the at least one tube;

retracting the probe into the conduit;

moving the conduit to place the conduit in communication with the interior of a second of said plurality of tubes; and moving the probe pusher on the elevator forward towards or backwards from the general direction of the tubes when the conduit is moved from the at least one of the tubes to maintain the slack in the conduit substantially the same for each tube.

* * * * *